US005433379A

United States Patent [19]

Harrison

[11] Patent Number: 5,433,379

[45] Date of Patent: Jul. 18, 1995

[54] DUAL TANK WATER HEATING SYSTEM

[76] Inventor: Charles Harrison, 1307 W. Erie St., Chicago, Ill. 60622

[21] Appl. No.: 263,061

[22] Filed: Jun. 21, 1994

[51] Int. Cl.[6] ..... F24D 3/08

[52] U.S. Cl. ..... 237/8 R; 237/19; 392/454; 392/458

[58] Field of Search ..... 237/19, 8 R; 126/361, 126/362; 392/454, 458, 445, 450

[56] References Cited

U.S. PATENT DOCUMENTS

| | | | |
|---|---|---|---|
| 2,299,122 | 10/1942 | Battin | 122/14 |
| 3,580,224 | 5/1971 | Bois-Colombes | 122/16 |
| 3,709,198 | 1/1973 | Williams | 122/14 |
| 4,242,569 | 12/1980 | Kayser | 219/314 |
| 4,632,180 | 12/1986 | Lauderdale | 165/70 |
| 4,664,096 | 5/1987 | Narang | 126/351 |
| 4,993,402 | 2/1991 | Ripka | 126/361 |

OTHER PUBLICATIONS

Instruction Manual of ITT Bell & Gossett, entitled "Reducing Valves. Installation, Operating and Service Instructions", V55999, Revision 1, (1992).

Instruction Manual of Amtrol Inc., "Installation and Operation Instructions—The Fill-Trol Unit", Form 109-1 (Undated).

*Primary Examiner*—William E. Tapolcai

*Attorney, Agent, or Firm*—Marshall, O'Toole, Gerstein, Murray & Borun

[57] ABSTRACT

A dual tank water heating system has an exterior tank which surrounds an interior tank. Water in the exterior tank is maintained at a prescribed temperature by heating elements located beneath the outer tank. Water in the interior tank is heated by water in the exterior tank and, when necessary, may be heated by a secondary heating element located beneath the interior tank. Water in the exterior tank may be used for general residential and commercial purposes and water in the interior tank is pumped through radiators for hydronic heating. Under moderate weather conditions, all heat is provided to the radiators through water in the interior tank which has been heated by water in the exterior tank. Under particularly cold circumstances, the secondary heating element is used to boost the heating ability of the system.

7 Claims, 3 Drawing Sheets

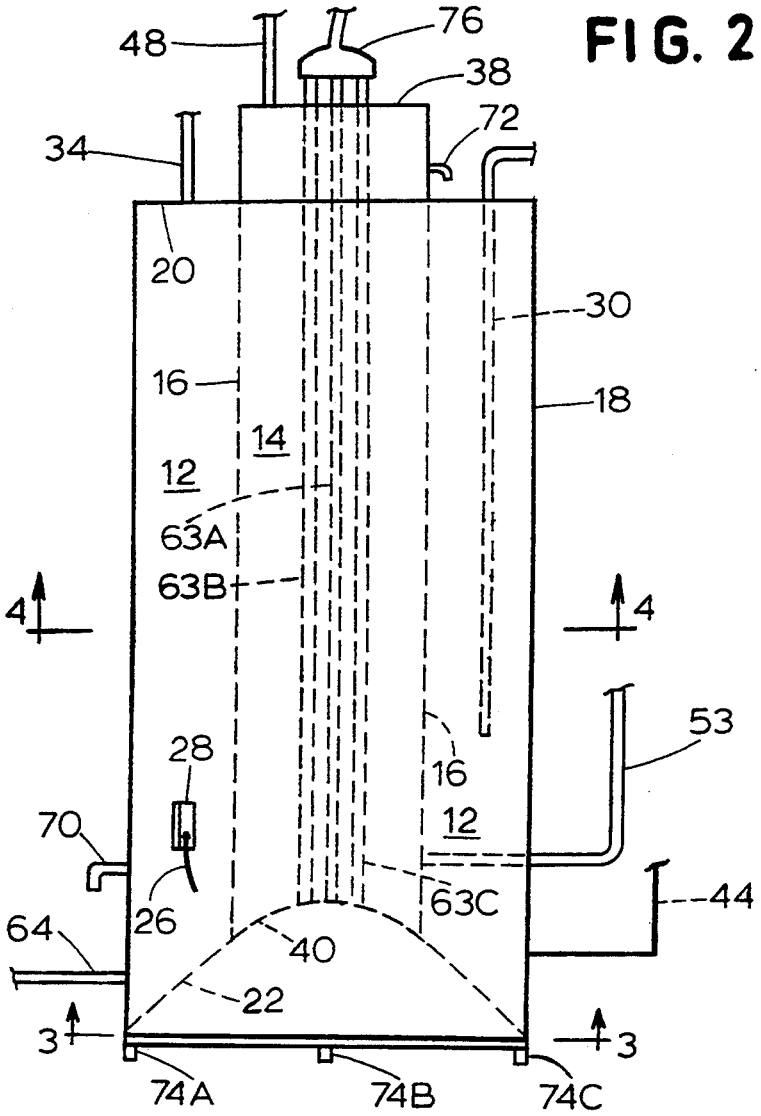
FIG. 2
FIG. 3
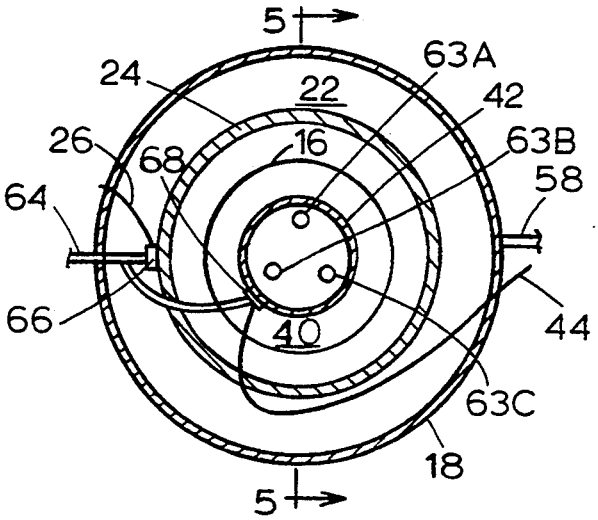

DUAL TANK WATER HEATING SYSTEM

BACKGROUND OF THE INVENTION

1. Field of Invention

The present invention relates generally to devices for providing hot water for hydronic heating and for general residential or commercial use and more particularly to devices in which water for hydronic heating is heated by placing it in proximity to hot water for general residential or commercial use.

2. Background Art

Conventional hot water heaters are usually of the tank-type having an electric, gas or similarly powered heating element at its bottom. The tank may have an interior opening through which flue gases from the heating element may pass for exhaust outside of the home. A cold water inlet provides water to the tank, and an outlet from the tank is connected to sinks, dishwashers, washing machines, bathtubs or other devices which use hot water.

Devices for hydronic heating are generally also of the tank-type and may be heated by a variety of fuels including natural gas, oil, coal or electricity. Hydronic heating tanks are often connected to a pump which forces water from the tank and into radiators that are placed in rooms for which heating is desired. The heating system water is usually separate from the hot water system provided for general use. The provision of separate systems not only requires separate materials, but also does not take advantage of heat loss from the tanks by transferring it from one system to the other.

SUMMARY OF THE INVENTION

In accordance with the present invention, a heating system has a first tank with an associated first heat source where the heat source provides heat to a first fluid having a temperature in the first tank in response to the temperature of the first fluid. A second tank, having a second fluid inlet and a second fluid outlet, is proximate the first tank for transferring heat from the first fluid to a second fluid in the second tank. A pump is connected to the second fluid inlet for pumping the second fluid to the second tank from a radiator in a room having an air temperature. A second heat source is provided for heating the second tank in response to the air temperature in the room.

The second fluid tank may be located within the first tank. The first tank may have a cylindrical shape and the second tank may have a cylindrical shape and be concentric with the first tank.

The first heat source may be a ring and the second source may be a second ring concentric with the first ring. The first and second heat sources may be devices for combustion of flammable materials which may produce gaseous combustion products, and the second tank may contain at least one flue pipe for exhausting the combustion products from the first and second heat sources.

The first tank may contain water and have a first fluid inlet and first fluid outlet where the first fluid outlet communicates with devices in the home which expel hot water.

A thermostat may be placed in the room which sends a first signal to the pump to start the pump when the air temperature in the room is below a first level and sends a second signal to the second heat source when the air temperature in the room is below a second level.

BRIEF DESCRIPTION OF THE DRAWINGS

Other features and advantages of the invention will be apparent from the following description taken in connection with the drawings wherein:

FIG. 2 is an elevational view partially in phantom of the dual tank of the present invention;

FIG. 3 is a sectional view taken along the line 3—3 of FIG. 2;

DETAILED DESCRIPTION

Figure 1:
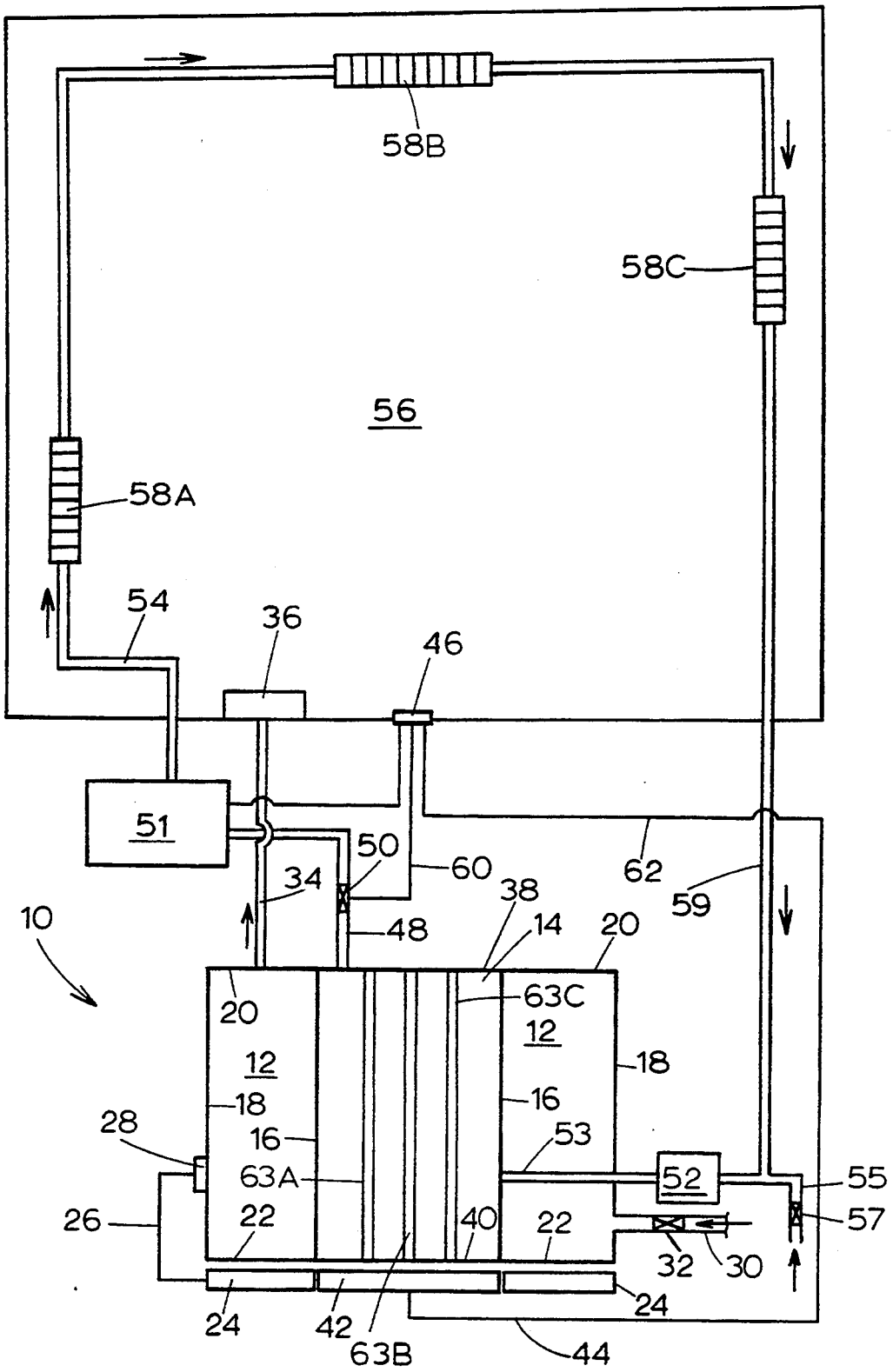
FIG. 1 is a block diagram of the dual tank heating system of the present invention.
Figure 4:
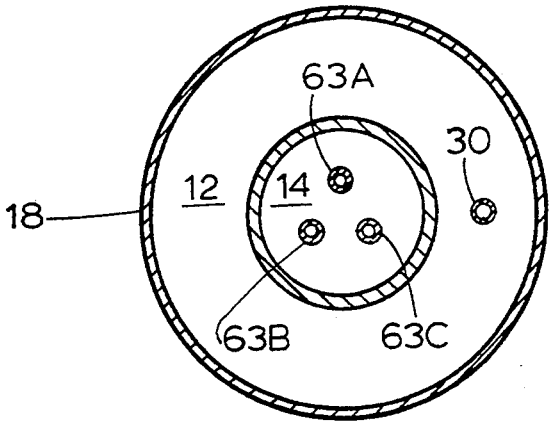
FIG. 4 is a sectional view taken along the line 4—4 in FIG. 2.
Figure 5:
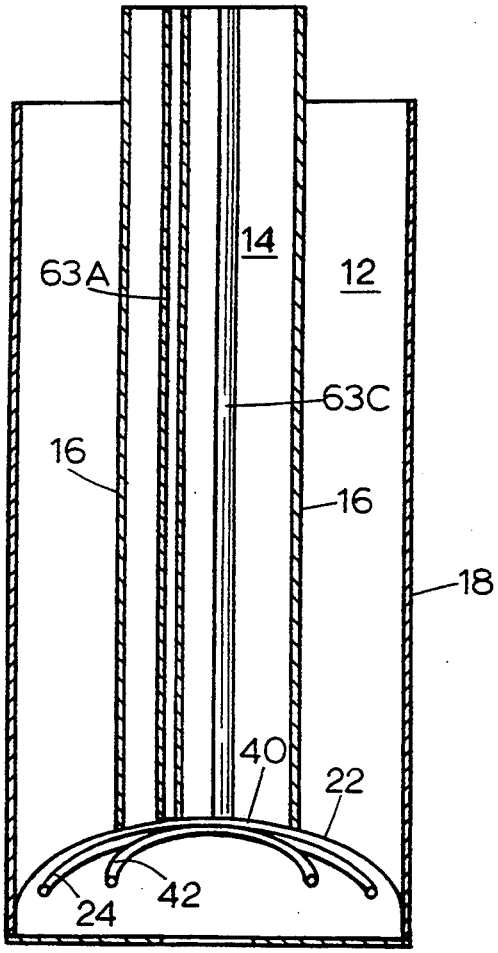
FIG. 5 is a sectional view taken along the line 5—5 in FIG. 3.

Referring initially to FIG. 1, a dual tank heating system 10 has an outer tank 12 and an inner tank 14 separated by an interior wall 16. The outer tank 12 has an outer wall 18, an upper wall 20 and a lower wall 22. In the diagrammatic view of FIG. 1 the outer tank 12 is shown in two parts to schematically represent that the outer tank 12 surrounds the inner tank 14.

Beneath the outer tank 12 is an outer tank heating element 24 (also shown in two parts) which is connected by a wire 26 to a thermostat 28. The outer tank heating element 24 is preferably a natural gas burner, but may also be a device which uses electricity, gas, coal, solar power or another energy source to heat water contained in the outer tank 12. The thermostat 28 gauges the temperature of the water inside the outer tank 12 and causes the outer tank heating element 24 to provide heat to the outer tank 12 whenever the temperature of the water in the outer tank 12 falls below a preset level.

A cold water inlet line 30 is connected through a valve 32 to the outer tank 12 to provide water as needed to the outer tank 12. A hot water outlet line 34 connects the outer tank 12 to a fixture 36 which uses hot water. The fixture 36 may be any conventional residential or commercial device which uses or expels hot water such as a sink, bathtub, shower, washing machine, dishwasher, etc. The outer tank 12, and its associated piping and heating element, work in a fashion similar to conventional hot water heaters used for providing water to devices such as fixture 36.

The inner tank 14 is formed by the interior wall 16, an upper wall 38 and a lower wall 40. An inner tank heating element 42 underneath the inner tank 14 provides heat to water inside the inner tank 14 and is controlled through a wire 44 by a room thermostat 46. The inner tank heating element 42 may use the same types of heat sources as those discussed above for the outer tank heating element 24. A hot water outlet conduit 48 is connected by a valve 50 to an expansion tank 51, such as the Fill-Trol unit manufactured by Amtrol, Inc. of West Warwick, R.I. 02893. The expansion tank 51 and its associated pressure reducing valve maintain the system at or near a uniform pressure (approximately 12 p.s.i.g.) while water in the system is heating or cooling. Water flows from the expansion tank 51 through a conduit 54 into a room 56 where it passes through radiators 58A, 58B and 58C and then out of the room 56 through a return conduit 59. A pump 52 then pumps the water into inner tank 14 through an inlet conduit 53. The valve 50 on hot water outlet conduit 48 is controlled by the room thermostat 46 through a wire 60. The pump 52 is also controlled by the room thermostat 46 through a wire 62. A cold water inlet 55 is connected through a reducing valve 57 to the return conduit 59. The reducing valve 57, such as those manufactured by Bell & Gossett of Morton Grove, Ill., opens whenever pressure in return conduit 59 is below a prescribed level. In this way, fresh water is supplied to the system whenever it evaporates or bleeds off the system.

Flue pipes 63A, 63B and 63C inside the inner tank 14 are provided for exhaustion of gaseous combustion products when the outer tank heating element 24 or the inner tank heating elements 42 are of the type that produce such products when burning flammable materials. Having the flue pipes 63A, 63B and 63C pass through the inner tank 14 is advantageous in that residual heat in the flue gases may be transferred to the water in the inner tank 14.

During warm weather conditions, the thermostat 46 closes the valve 50, keeps the pump 52 off and does not allow the inner tank heating element 42 to provide heat to the inner tank 14. Therefore, no hot water is provided to radiators 58A, 58B and 58C and the room 56 is not heated. Water in the outer tank 12 is still kept hot by the outer tank heating element 24 for use in devices such as the fixture 36.

When the weather become colder, thereby decreasing the temperature in the room 56, room thermostat 46 opens the valve 50 and turns on the pump 52 so that water flows from the inner tank 14 through radiators 58A, 58B and 58C. During this second mode of operation, water returning from the radiators 58A, 58B and 58C is pumped into the inner tank 14 and is heated through the interior wall 16 by the water contained in the outer tank 12. Once the water in the inner tank 14 has been warmed, it is then sent through the hot water outlet conduit 48, through the expansion tank 51 and back to the radiators 58A, 58B and 58C. The heat which is removed from the water in the outer tank 12 by the water circulating through inner tank 14 decreases the temperature in the outer tank 12 and causes the thermostat 28 to initiate heating in the outer tank heating element 24. Therefore, in this second mode of operation, all heat used to increase the temperature in room 56 flows initially from the outer tank heating element 24. Since the outer tank heating element 24 will maintain the water in the outer tank 12 at a high temperature, hot water will be available for general use.

A third mode of operation is possible when the temperature is extremely cold and the room 56 cannot be maintained at an acceptable temperature solely through use of heating provided through outer tank heating element 24. In the third mode of operation the thermostat 46 opens the valve 50 and turns on the pump 52, as in the second mode of operation, but also turns on the inner tank heating element 42. When water flows through the inner tank 14, it is heated not only by the water in outer tank 12, but also by the inner tank heating element 42. Therefore, in the third mode of operation, the inner tank heating element 42 acts as a booster or secondary heat source to provide additional energy needed to maintain the air in room 56 at an acceptable temperature.

Referring now to FIGS. 2–5, additional features of the outer tank 12 and the inner tank 14 are provided. The outer tank 12 has a cylindrical shape, as does the inner tank 14. The two tanks are oriented so as to be concentric, with the top of the inner tank 14 terminating above the top of the outer tank 12. Providing concentric tanks can be easily accomplished using conventional hot water heaters, because most hot water heaters have a hollow interior through which flue gases pass. Such a heater can be modified by enclosing the hollow interior to form an interior tank and then placing pipes such as flue pipes 63A, 63B and 63C, in the interior tank for exhaust.

The bottom wall 22 of outer tank 12 and bottom wall 40 of inner tank 14 are curved (FIG. 3) so that the center of the bottom of inner tank 14 is higher than the bottom of outer tank 12. This configuration is desirable so that combustion products from the heating elements 24 and 42 are directed upwards into flue pipes 63A, 63B, 63C.

In addition to the structures previously discussed, the system also has a gas inlet pipe 64 which is connected to a pilot 66 on the outer tank heating element 24 and a pilot 68 on the inner tank heating element 40. The pilots 66 and 68 are connected to the wires 26 and 44, respectively, for control by the thermostats 28 and 46, respectively.

A drain 70 is provided on the outer tank 12 and a drain 72 is provided on the inner tank 14 for removing water from the system. The dual tank is provided with legs 74A, 74B and 74C (FIG. 2), which allow air flow underneath the tank for use in combustion. A collector 76 is provided at the top of the flue pipes 63A, 63B and 63C to collect exhaust gases from the heating elements and direct them out of the building.

The dimensions of the dual tank will depend on the amount of hot water needed for residential or commercial use as well as the size of the rooms for which heating is desired and the temperature extremes which may be encountered. For instance, a 40-gallon outer tank having an 18-inch outside diameter and a height of 42 inches containing an inner tank with a 6-inch diameter has been found to be sufficient for heating a small apartment. An 8-inch diameter outer tank heating element 24 for burning natural gas and a 3 inch inner tank heating element 42 for burning natural gas may be provided under the tanks.

The foregoing detailed description has been provided for clearness of understanding and no unnecessary limitations should be understood therefrom, as modifications will be obvious to those skilled in the art.

I claim:

1. A heating system comprising:

a first tank having an associated first heat source, wherein the first heat source provides heat to a first fluid having a temperature in the first tank in response to the temperature of the first fluid;

a second tank having a second fluid inlet and a second fluid outlet wherein the second tank is proximate the first tank for transferring heat from the first fluid to a second fluid in the second tank;

a pump connected to the second fluid inlet for pumping the second fluid into the second tank from a radiator in a room having an air temperature;

a second heat source for heating the second tank in response to the air temperature in the room; and a thermostat in the room which sends a first signal to the pump to start the pump when the air temperature in the room is below a first level and sends a second signal to the second heat source when the air temperature in the room is below a second level.

2. The heating system of claim 1 wherein the second tank is located within the first tank.

3. The heating system of claim 2 wherein:

the first tank has a cylindrical shape; and the second tank has a cylindrical shape and is concentric with the first tank.

4. The heating system of claim 3 wherein:

the first heat source comprises a first ring; and the second heat source comprises a second ring concentric with the first ring.

5. The heating system of claim 2 wherein:

the first and second heat sources comprise devices for combusting flammable materials and the first and second heat sources produce gaseous combustion products; and the second tank contains at least one flue pipe for exhausting the combustion products from the first and second heat sources.

6. The heating system of claim 1 wherein:

the first tank contains water and has a first fluid inlet and a first fluid outlet; and the first fluid outlet communicates with devices in a home which expel hot water.

7. A heating system comprising:

a first tank having an associated first heat source, wherein the heat source provides heat to a first fluid having a temperature in the first tank in response to the temperature of the first fluid;

a second tank having a second fluid inlet and a second fluid outlet wherein the second tank is proximate the first tank for transferring heat from the first fluid to a second fluid in the second tank;

a pump connected to the second fluid inlet for pumping the second fluid to the second tank from a radiator in a room having an air temperature;

a second heat source for heating the second tank in response to the air temperature in the room; and a thermostat in the room which sends a first signal to the pump to start the pump when the air temperature in the room is below a first level and sends a second signal to the second heat source when the air temperature in the room is below a second level;

wherein the second tank is located within the first tank;

the first tank has a cylindrical shape and the second tank has a cylindrical shape and is concentric with the first tank;

the first heat source comprises a first ring and the second heat source comprises a second ring concentric with the first ring;

the first and second heat sources comprise devices for combusting flammable materials and the first and second heat sources produce gaseous combustion products;

the second tank contains at least one flue pipe for exhausting the combustion products from the first and second heat sources;

the first tank contains water and has a first fluid inlet and a first fluid outlet;

the first fluid outlet communicates with devices in a home which expel hot water.

* * * * *